US006409482B1

(12) United States Patent
Fon

(10) Patent No.: US 6,409,482 B1
(45) Date of Patent: Jun. 25, 2002

(54) DOUBLE-FORCE TYPE PRESSURE CYLINDER STRUCTURE

(76) Inventor: Wang Wing Fon, No. 135, Nan-Shih, Nan-Shih Li, Yuan-Li Chen, Miao-Li Hsien (TW)

( * ) Notice: Subject to any disclaimer, the term of this patent is extended or adjusted under 35 U.S.C. 154(b) by 122 days.

(21) Appl. No.: 09/661,149

(22) Filed: Sep. 13, 2000

(51) Int. Cl.[7] ..... F04B 17/00
(52) U.S. Cl. ..... 417/399; 417/401; 417/403
(58) Field of Search ..... 417/401, 403, 417/399

(56) References Cited

U.S. PATENT DOCUMENTS 4,029,442 A * 6/1977 Schlosser ..... 417/489
4,042,311 A * 8/1977 Yonezawa ..... 417/401
4,104,008 A * 8/1978 Hoffmann et al. ..... 417/397
4,189,285 A * 2/1980 Pauliukonis ..... 417/403
5,213,586 A * 5/1993 Welker ..... 48/195
5,328,339 A * 7/1994 Jong ..... 417/403
5,380,428 A * 1/1995 Solomon ..... 210/136

* cited by examiner

*Primary Examiner*—Michael Koczo
*Assistant Examiner*—William Rodriguez
(74) *Attorney, Agent, or Firm*—Rosenberg, Klein & Lee

(57) ABSTRACT

A double-force type pressure cylinder structure includes a gas cylinder secured on a pressurizing cylinder base, and a top cap secured on the gas cylinder. The pressurizing cylinder base has a liquid inlet port forming a first check valve, a liquid outlet port forming a second check valve, and a pressurizing cylinder chamber for receiving a piston rod. The gas cylinder includes a piston, a spring biased between the piston and an end face of the pressurizing cylinder base so that the piston is pushed upward by the spring. The circuit of the compressed air is controlled by air holes in conjunction with the spring so that the piston and the piston rod are reciprocally moved quickly for compressing the hydraulic oil at a high speed, thereby forming a thrust with a high pressure.

9 Claims, 14 Drawing Sheets

DOUBLE-FORCE TYPE PRESSURE CYLINDER STRUCTURE

BACKGROUND OF THE INVENTION

1. Field of the Invention

The present invention relates to a pressure cylinder structure, and more particularly to a double-force type pressure cylinder structure.

2. Description of the Related Art

A conventional clamping device, such as a vice, is used for clamping a workpiece to be worked by a working machine such as a milling machine. However, the vice is operated manually so that the clamping and holding effect provided by the vice on the workpiece is not sufficient and efficient, thereby greatly affecting the working efficiency of the working machine.

SUMMARY OF THE INVENTION

In accordance with one aspect of the present invention, there is provided a double-force type pressure cylinder structure comprising:

a pressurizing cylinder base defining a radial through hole having a first side threadedly provided with a liquid inlet port having a distal end for receiving a first ball, thereby forming a first check valve, and having a second side threadedly provided with a liquid outlet port having a distal end for receiving a second ball, thereby forming a second check valve, the pressure cylinder base having a central portion defining a pressurizing cylinder chamber for receiving a piston rod, the pressurizing cylinder chamber having a top defining a screw hole for receiving a sealing bushing, a support bushing screwed into the screw hole for securing the sealing bushing and for supporting the piston rod which is sealed by the sealing bushing;

a gas cylinder secured on the pressurizing cylinder base and containing a piston therein, the piston having a bottom defining an inner annular hole for receiving a flange disk, the flange disk having a central portion screwed on one end of the piston rod, a spring having a first end secured on the flange disk and a second end secured on an end face of the pressurizing cylinder base so that the piston is pushed upward by the spring, a main air drain hole longitudinally defined in a wall of the gas cylinder and extending into a bottom of the gas cylinder, a direction change air drain hole longitudinally defined in the wall of the gas cylinder and extending into a mediate portion of the gas cylinder; and a top cap secured on the gas cylinder by bolts and having a central portion defining a through stepped hole, the stepped hole provided with an inner flange, the inner flange having a bottom for receiving a lower piston base and a top for receiving an upper piston base which is screwed by bolts, the upper piston base defining an inner cylinder chamber, the lower piston base having an upper portion defining a concave annular hole for receiving an upper valve plug and a lower valve plug, and having a lower portion for receiving a spline which defines a plurality of radially arranged slots, an O-ring mounted on a distal end of the spline, a direction change piston slidably mounted in the inner cylinder chamber of the upper piston base and having an axle extending into the upper valve plug and abutting an end face of the spline, a threaded post extending through a block ring, through the spline and screwed into the axle of the direction change piston so that the spline is integrally coupled with the direction change piston while the block ring closes the slots of the spline.

Further benefits and advantages of the present invention will become apparent after a careful reading of the detailed description with appropriate reference to the accompanying drawings.

DETAILED DESCRIPTION OF THE INVENTION

Figure 1:
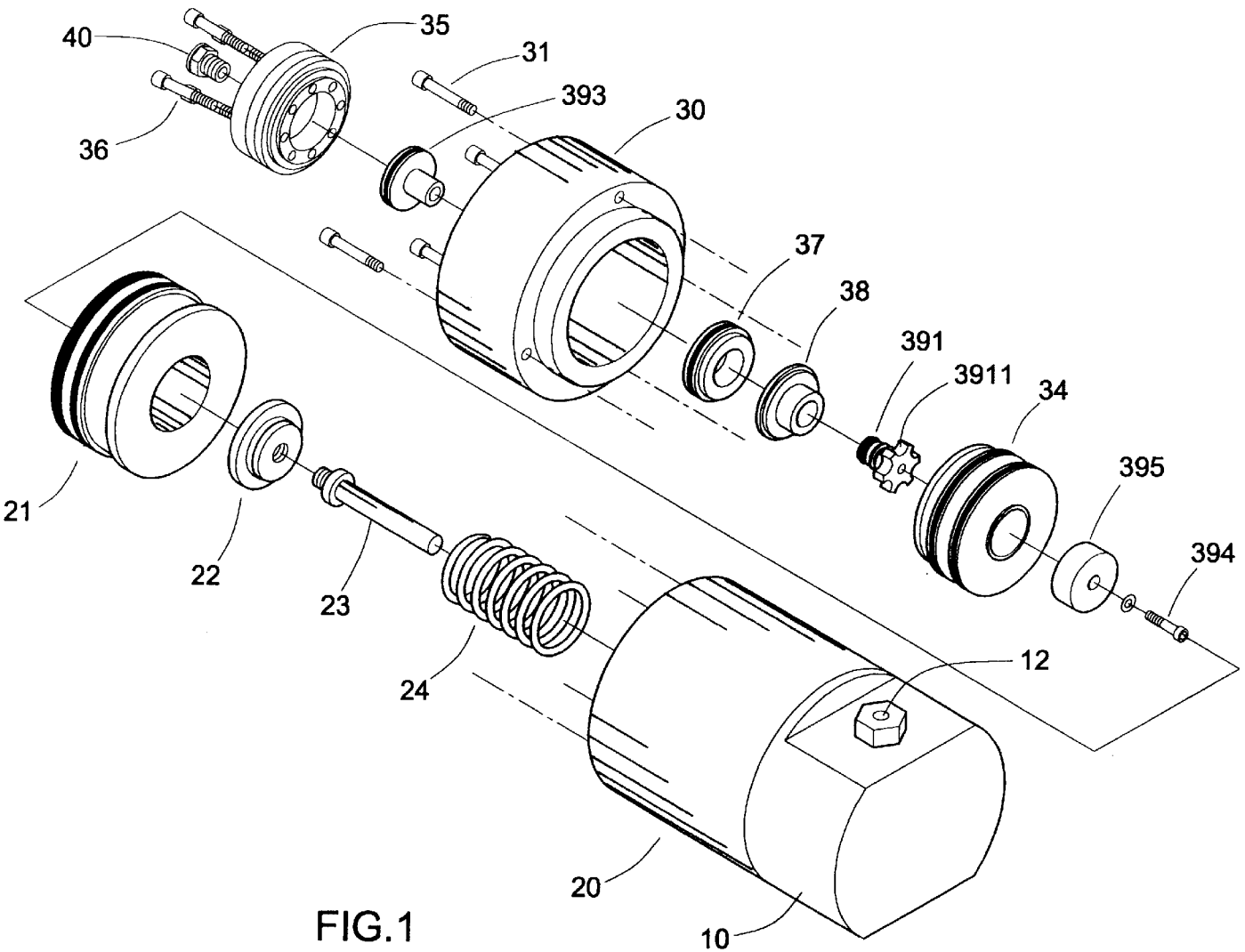
FIG. 1 is an exploded view of a double-force type pressure cylinder structure in accordance with the present invention.
Figure 2:
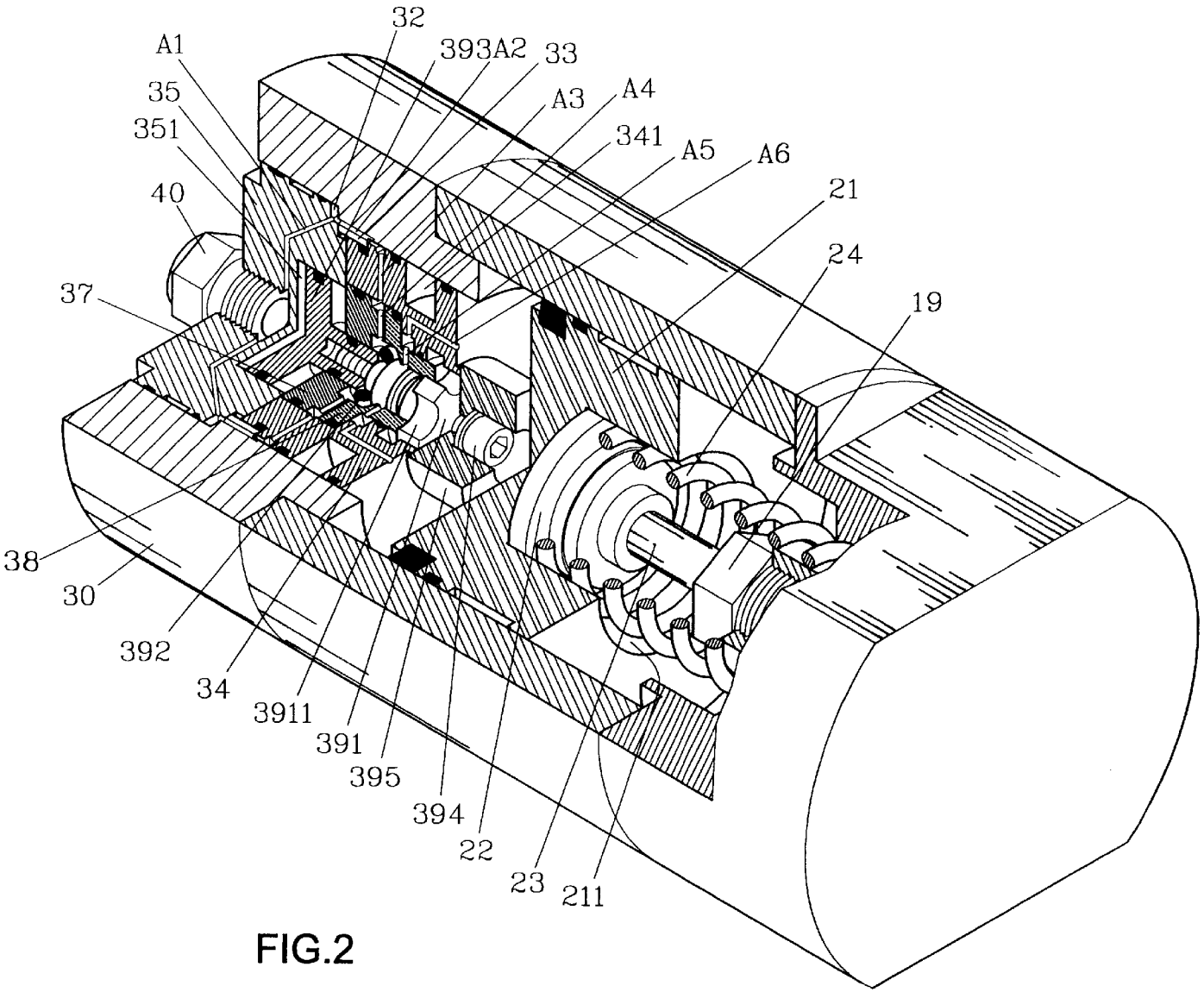
FIG. 2 is a partially perspective cross-sectional assembly view of the double-force type pressure cylinder structure as shown in FIG. 1.
Figure 3:
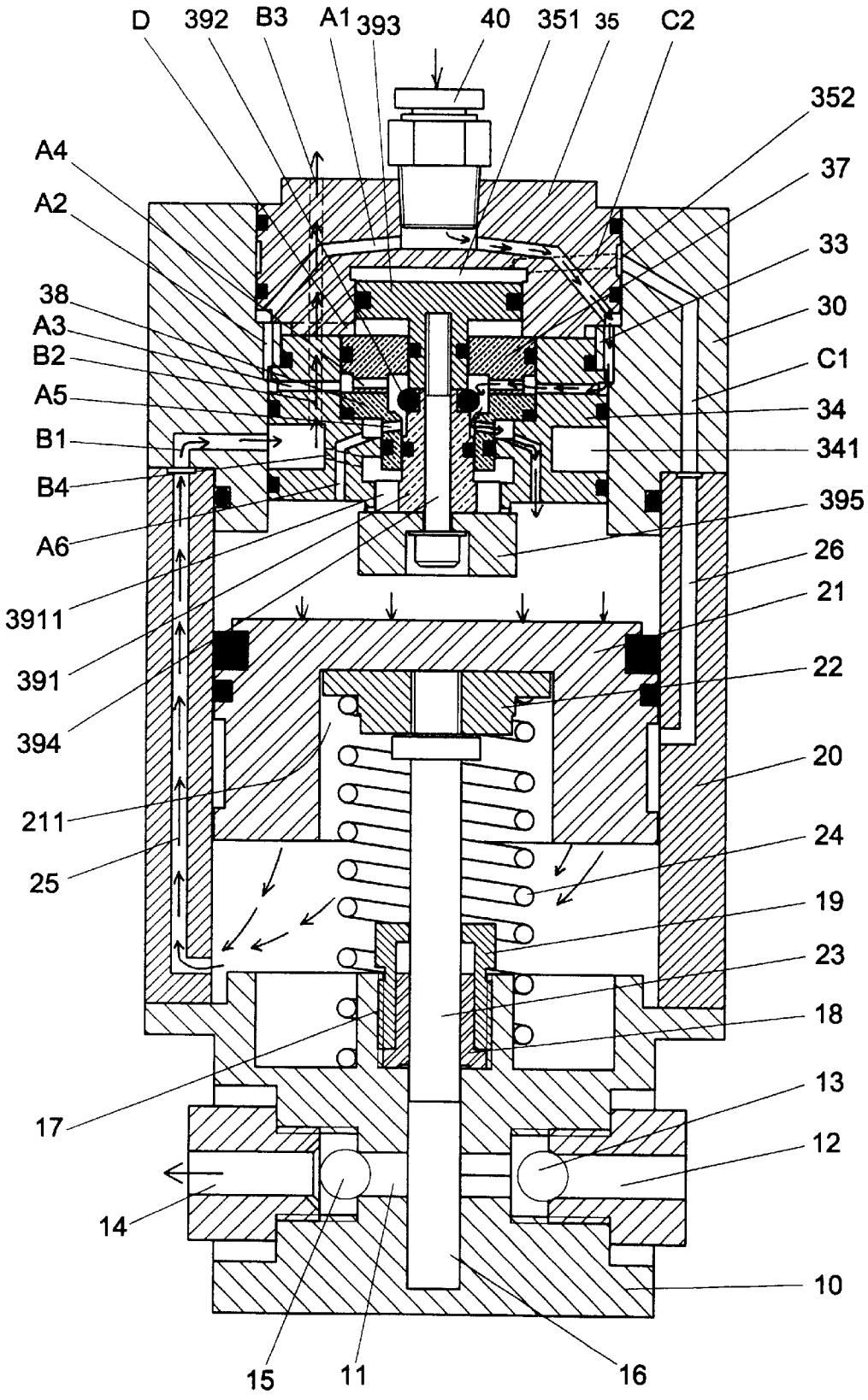
FIG. 3 is a cross-sectional assembly view of the double-force type pressure cylinder structure as shown in FIG. 1.

Referring to the drawings and initially to FIGS. 1–3, a double-force type pressure cylinder structure in accordance with the present invention comprises a pressurizing cylinder base 10, a gas cylinder 20, and a top cap 30.

The pressurizing cylinder base 10 defines a radial through hole 11 having a first side threadedly provided with a liquid inlet port 12 having a distal end for receiving a first ball 13, thereby forming a first check valve, and having a second side threadedly provided with a liquid outlet port 14 having a distal end for receiving a second ball 15, thereby forming a second check valve. The pressure cylinder base 10 has a central portion defining a pressurizing cylinder chamber 16 for receiving a piston rod 23. The pressurizing cylinder chamber 16 has a top defining a screw hole 17 for receiving a sealing bushing 18. A support bushing 19 is screwed into the screw hole 17 for securing the sealing bushing 18 and for supporting the piston rod 23 which is sealed by the sealing bushing 18.

The gas cylinder 20 is secured on the pressurizing cylinder base 10 and contains a piston 21 therein. The piston 21 has a bottom defining an inner annular hole 211 for receiving a flange disk 22. The flange disk 22 has a central portion screwed on one end of the piston rod 23. A spring 24 has a first end secured on the flange disk 22 and a second end secured on an end face of the pressurizing cylinder base 10 so that the piston 21 is pushed upward by the spring 24. A main air drain hole 25 is longitudinally defined in the wall of the gas cylinder 20 and extends into the bottom of the gas cylinder 20. A direction change air drain hole 26 is longitudinally defined in the wall of the gas cylinder 20 and extends into a mediate portion of the gas cylinder 20.

The top cap 30 is secured on the gas cylinder 20 by bolts 31 and has a central portion defining a through stepped hole 32. The stepped hole 32 is provided with an inner flange 33 having a bottom for receiving a lower piston base 34 and a top for receiving an upper piston base 35 which is screwed by bolts 36. The upper piston base 35 defines an inner cylinder chamber 351. The lower piston base 34 has an upper portion defining a concave annular hole 343 for receiving an upper valve plug 37 and a lower valve plug 38 and has a lower portion for receiving a spline 391 which defines a plurality of radially arranged slots 3911. An O-ring 392 is mounted on a distal end of the spline 391. A direction change piston 393 is slidably mounted in the inner cylinder chamber 351 of the upper piston base 35 and has an axle extending into the upper valve plug 37 and abutting an end face of the spline 391. A threaded post 394 extends through a block ring 395, through the spline 391 and screwed into the axle of the direction change piston 393 so that the spline 391 is integrally coupled with the direction change piston 393 while the block ring 395 closes the slots 3911 of the spline 391.

The upper piston base 35 defines a first air hole A1 extending therethrough and has a top threadedly secured with an air inlet port 40 connected to the first air hole Al of the upper piston base 35. The inner flange 33 defines a second air hole A2 which has a first side connected to the first air hole A1 and a second side connected to a first radial hole A3 defined in the lower piston base 34. The first radial hole A3 has a distal end connected to a second radial hole A4 defined in the upper valve plug 37. The second radial hole A4 is connected between the upper valve plug 37 and the lower valve plug 38. An air vent hole A5 is defined in the lower valve plug 38 and is connected to an air guide hole A6 defined in the lower piston base 34. The air guide hole A6 is connected to a inside of the gas cylinder 20.

The top cap 30 defines a first air hole B1 connected to the main air drain hole 25 of the gas cylinder 20 and connected to an annular groove 341 defined in the lower piston base 34. A second air hole B2 is defined in the lower piston base 34 and is connected to the annular groove 341. An air drain hole B3 is defined in the upper piston base 35 and is connected to the second air hole B2. The lower piston base 34 defines an air supply hole B4 connected to the annular groove 341 and connected to the slots 3911 of the spline 39. The upper piston base 35 defines an air hole D connected to the air drain hole B3 of the upper piston base 35 and connected to the inner cylinder chamber 351.

The top cap 30 defines a first air hole Cl connected to the direction change air drain hole 25 of the gas cylinder 20 and connected to an annular groove 352 defined in the upper piston base 35. A second air hole C2 defined in the upper piston base 35 is connected between the annular groove 352 of the upper piston base 35 and the inner cylinder chamber 351 of the upper piston base 35.

Figure 4:
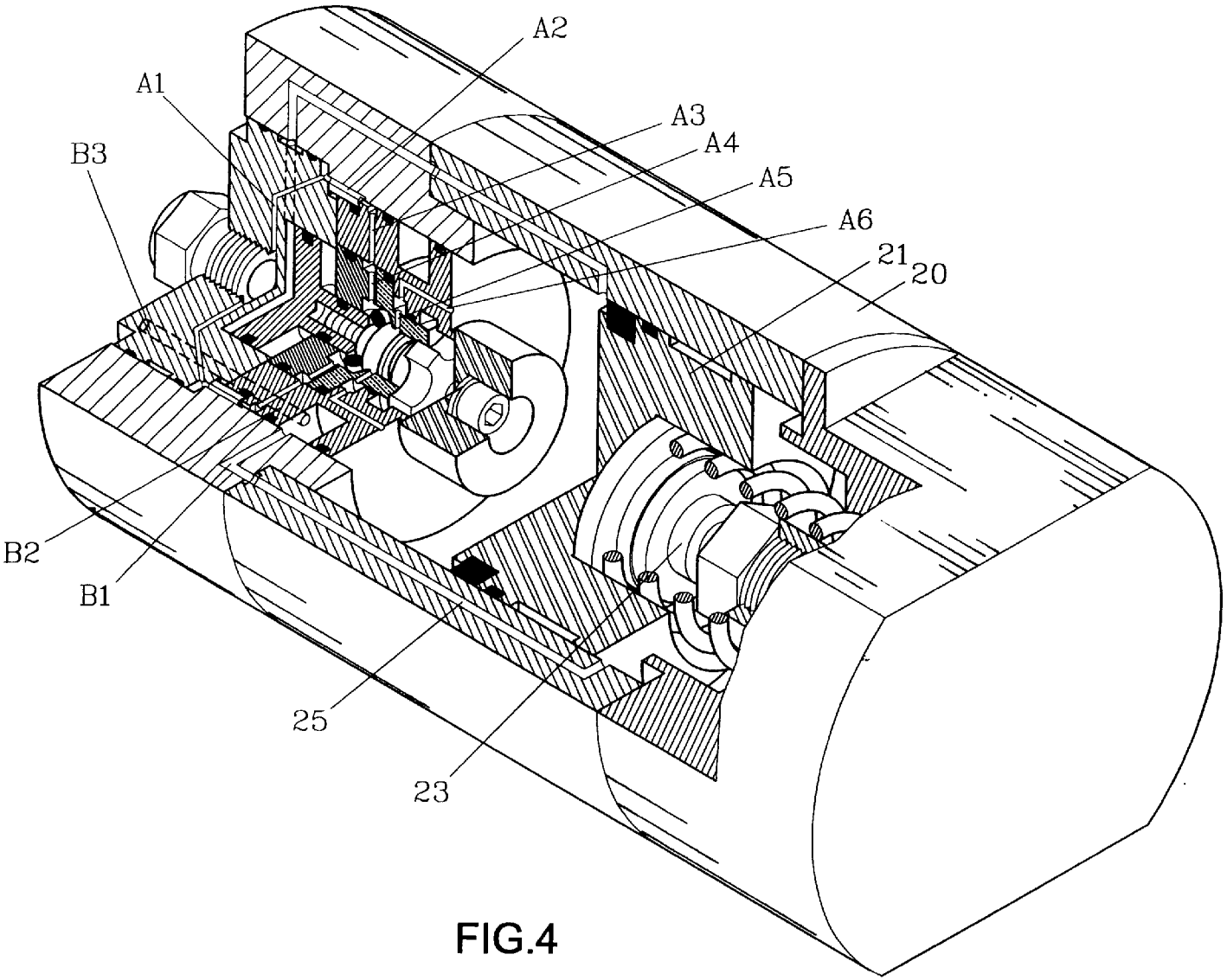
FIG. 4 is an operational view of the double-force type pressure cylinder structure as shown in FIG. 2.
Figure 5:
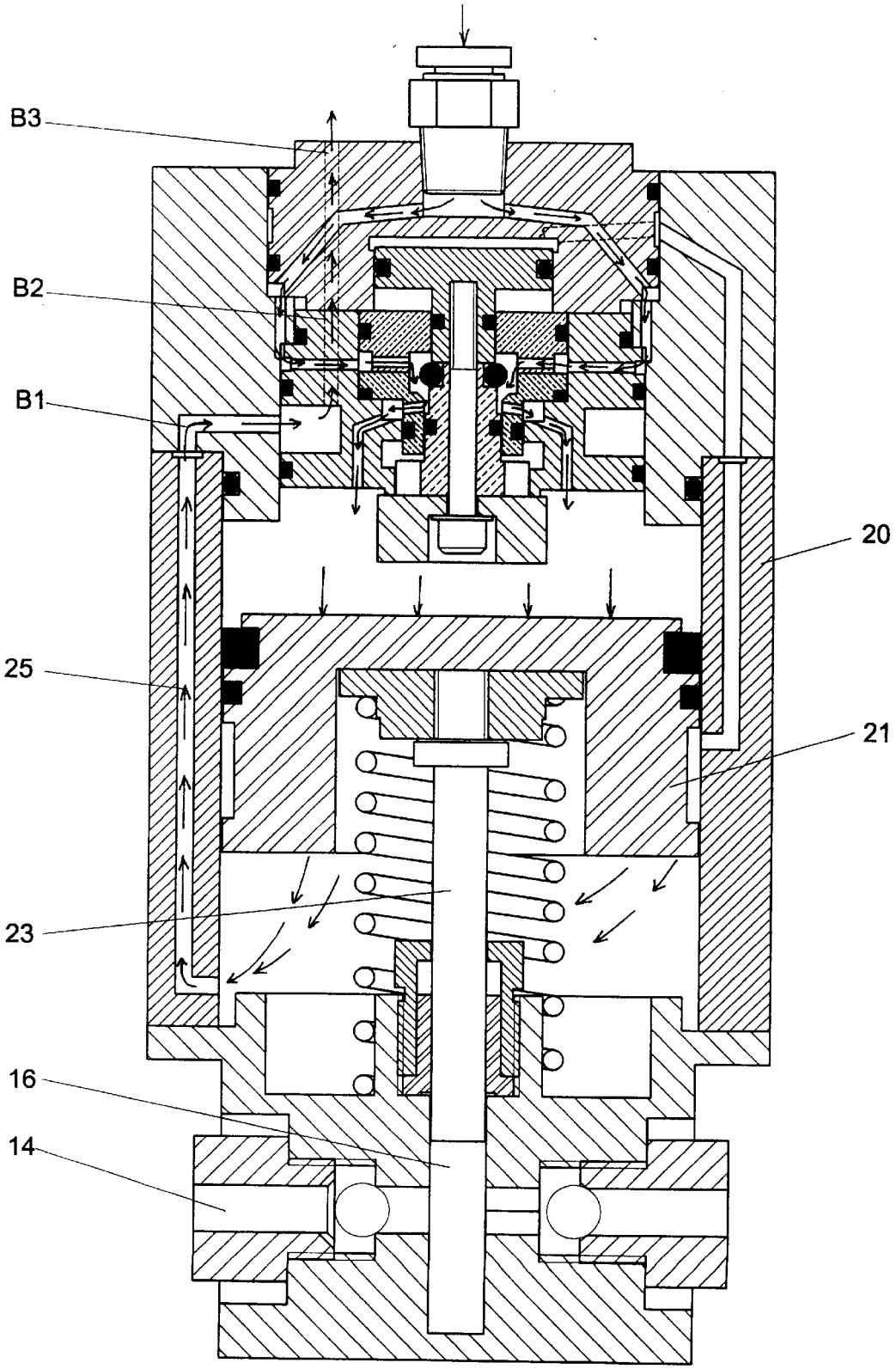
FIG. 5 is an operational view of the double-force type pressure cylinder structure as shown in FIG. 3.

In operation, referring to FIGS. 2 and 3, the compressed air supplied through the air inlet port 40 is introduced through the air holes A1 and A2, the radial air holes A3 and A4, the air vent hole A5, and the air guide hole A6 into the gas cylinder 20, thereby gradually increasing pressure on the piston 21 so as to push the piston 21 downward as shown in FIGS. 4 and 5. The air is then introduced through the main air drain hole 25, the air holes B1 and B2, and is drained to the ambient environment through the air drain hole B3 so that the piston 21 can be quickly moved downward. At the same time, the piston rod 23 is moved downward to compress the air in the pressurizing cylinder chamber 16, thereby forcing the hydraulic oil to flow toward the liquid outlet port 14 to be supplied into the oil cylinder of a double-force type vice (not shown).

Figure 6:
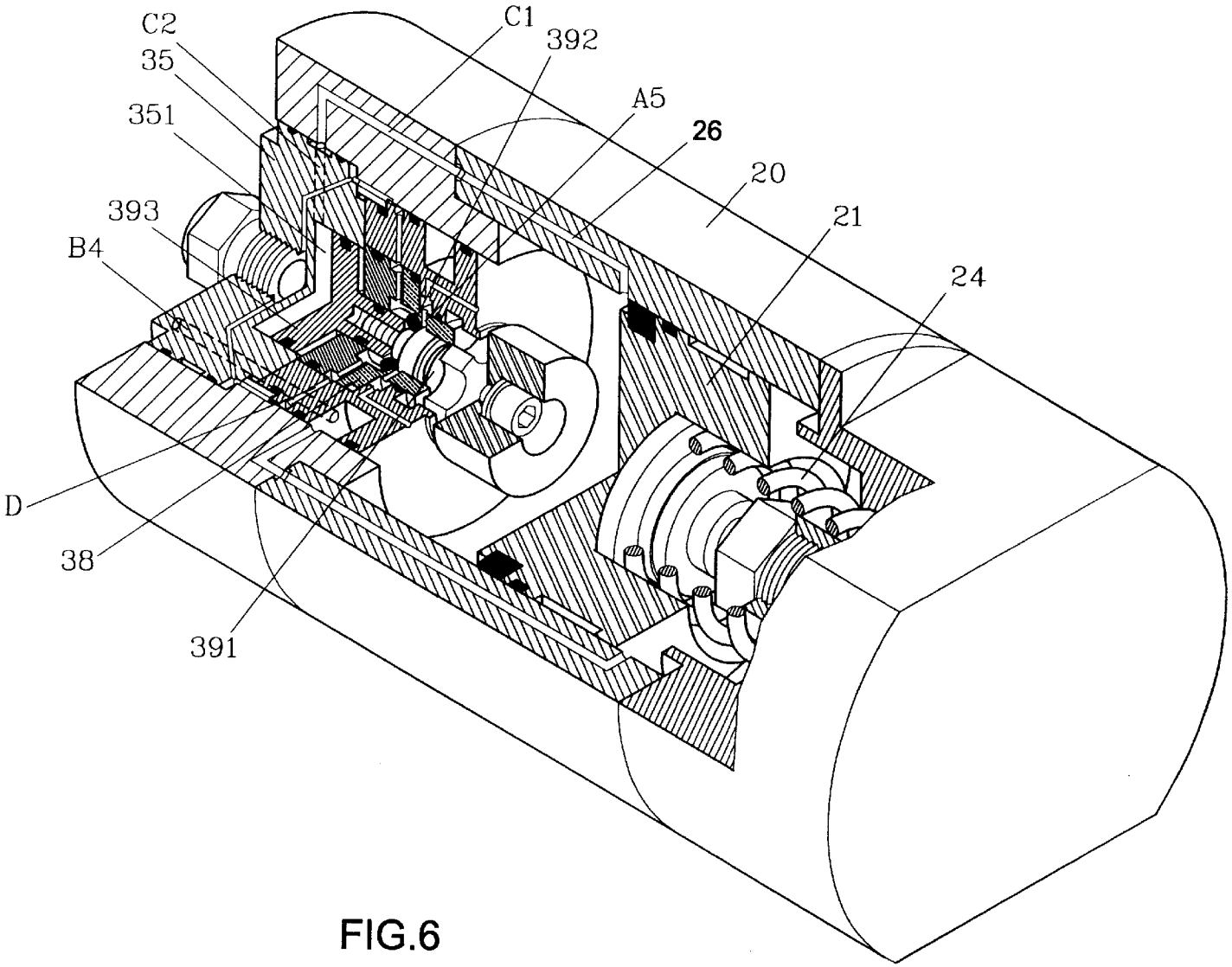
FIG. 6 is an operational view of the double-force type pressure cylinder structure as shown in FIG. 4.
Figure 7:
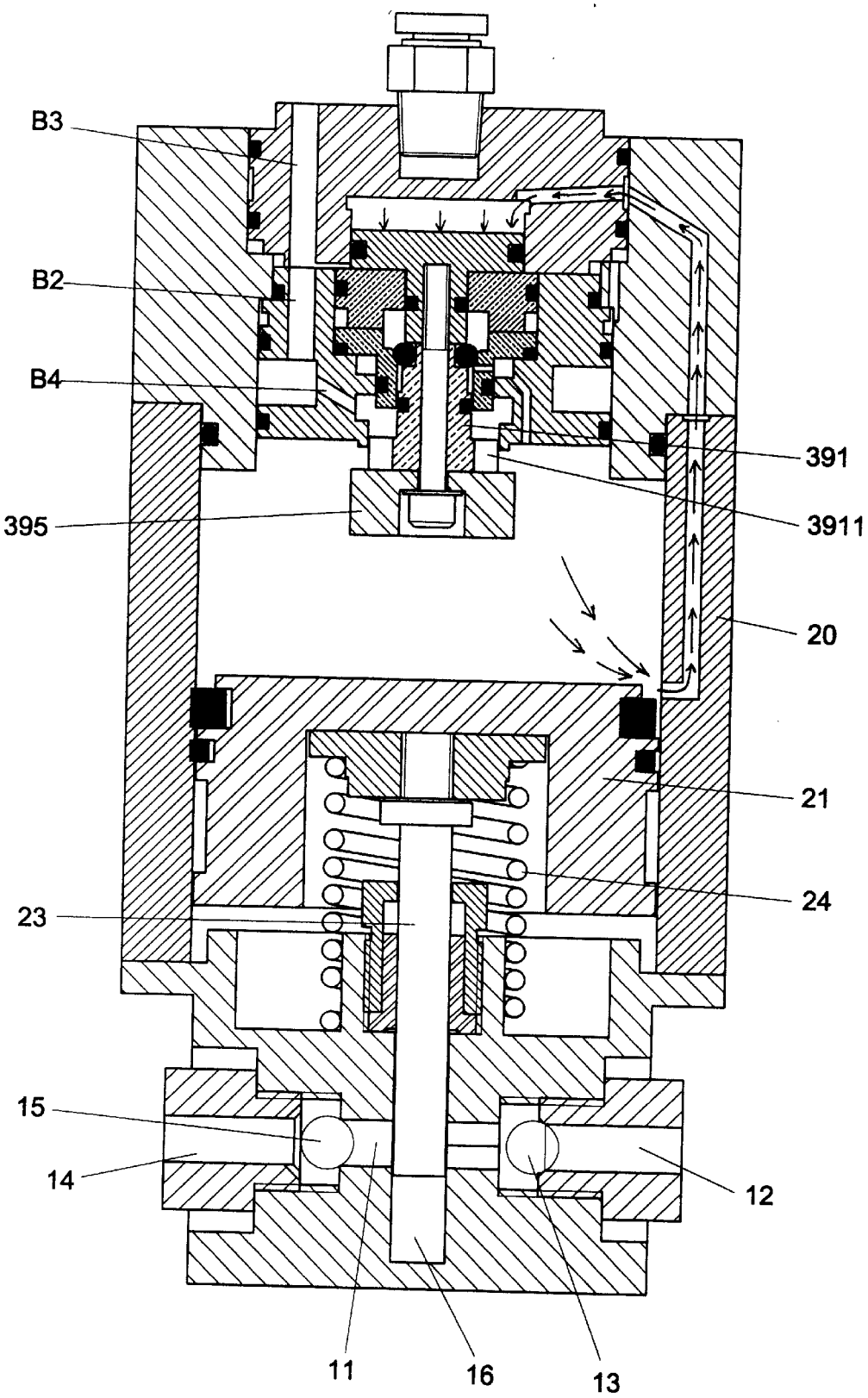
FIG. 7 is an operational view of the double-force type pressure cylinder structure as shown in FIG. 5.

Referring to FIGS. 6 and 7, when the piston 21 is moved to a position lower the level of the direction change air drain hole 26, the compressed air is introduced through the direction change air drain hole 26, the air holes C1 and C2, and into the inner cylinder chamber 351 of the upper piston base 35 to push the direction change piston 393 downward while the air in the front space of the direction change piston 393 is introduced through the air hole D and the air drain hole B3 and into the environment. When the direction change piston 393 is moved downward, the O-ring 392 on the spline 391 is moved to press the inner wall of the lower valve plug 38, thereby blocking the air hole A5 so that the pressure exerted on the piston 21 is decreased so that the piston 21 is moved upward by the thrust of the spring 24.

Figure 8:
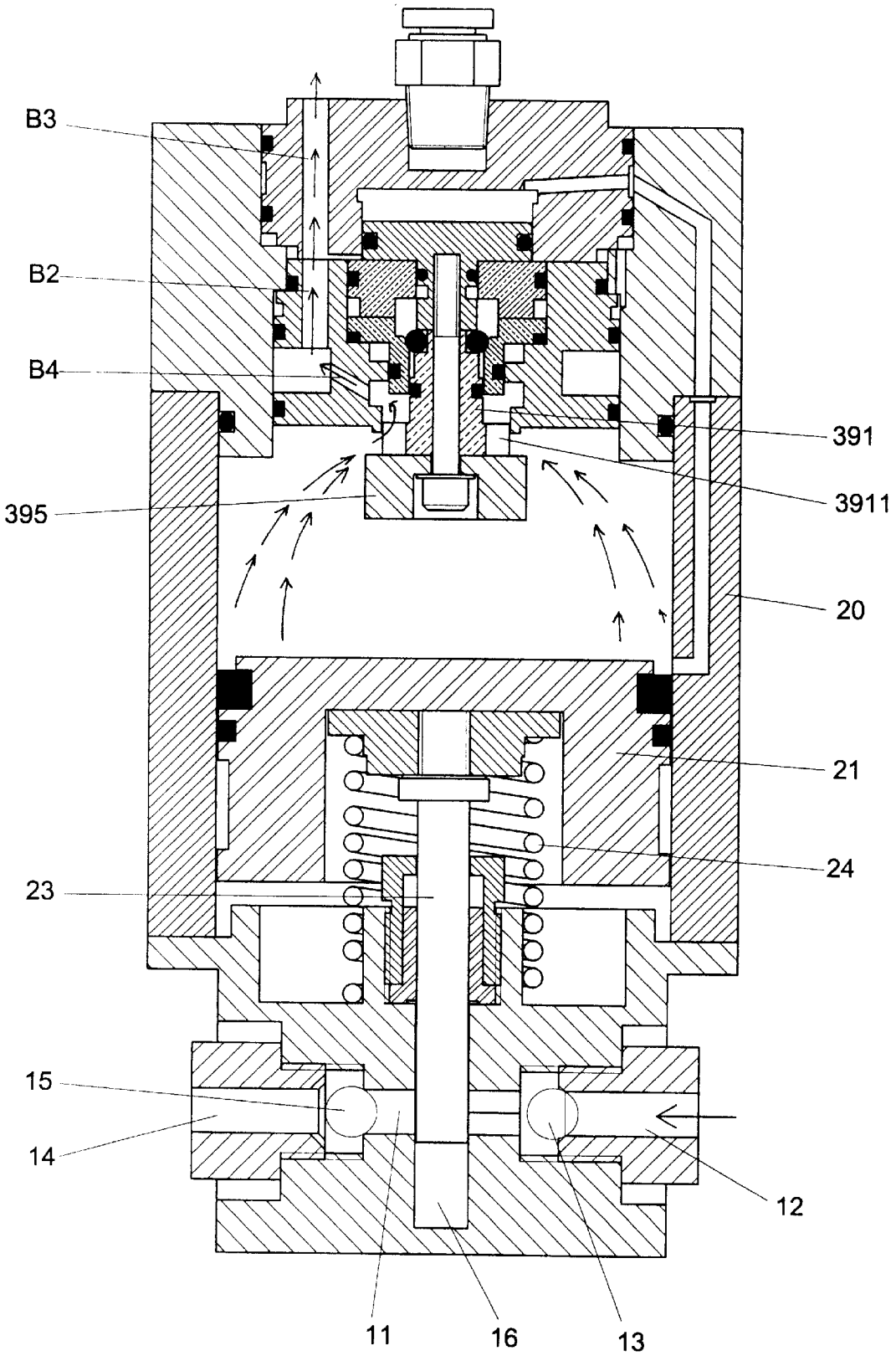
FIG. 8 is an operational view of the double-force type pressure cylinder structure as shown in FIG. 7.
Figure 9:
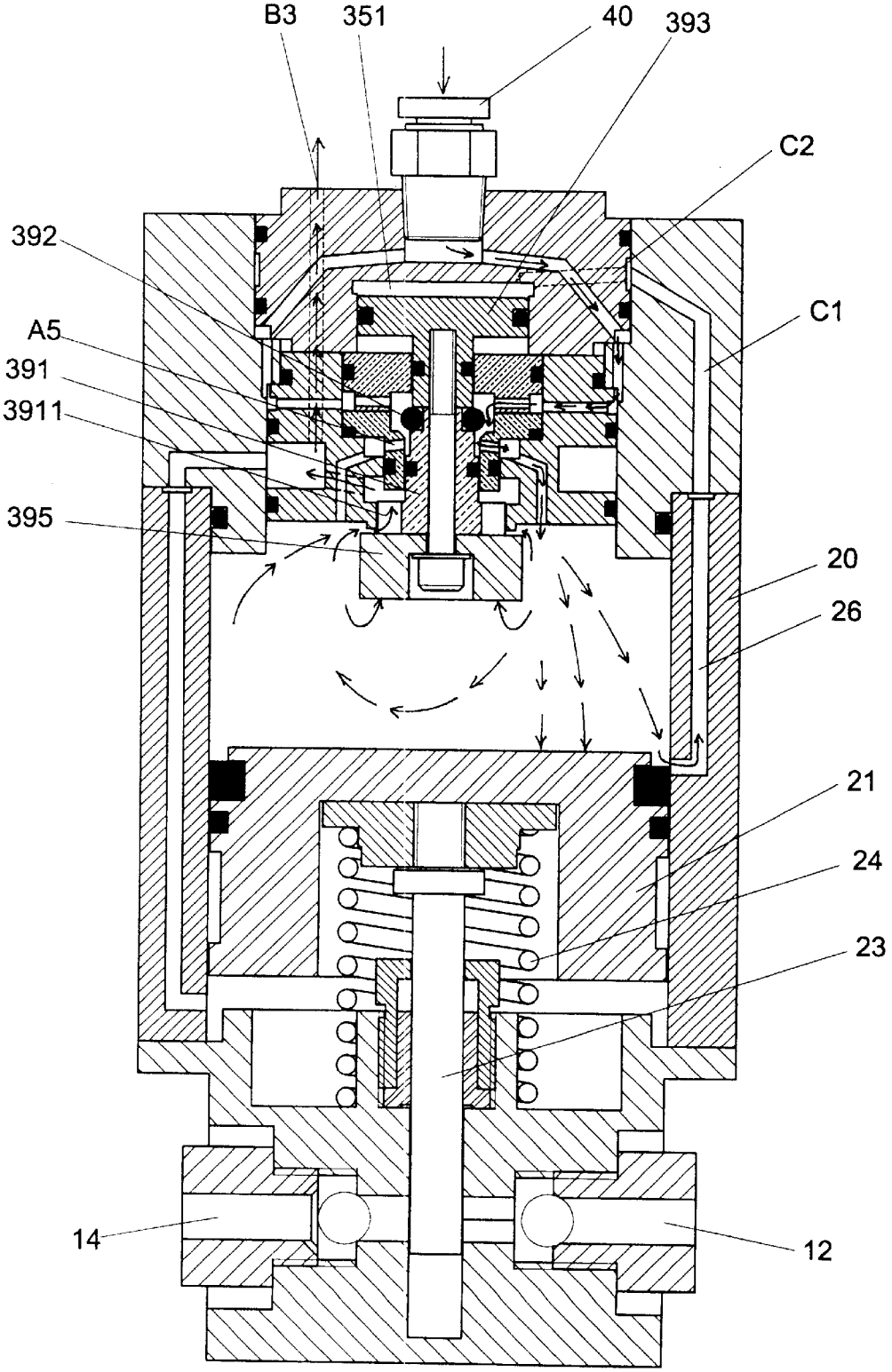
FIG. 9 is an operational view of the double-force type pressure cylinder structure as shown in FIG. 8.

Referring to FIGS. 8 and 9, the spline 391 is moved downward when the direction change piston 393 is moved downward so that the slots 3911 are connected to the gas cylinder 20. When the piston 21 is moved upward, the air is introduced through the slots 3911, the air supply hole B4, the air hole B2, and into the environment through the air drain hole B3 so that the piston 21 can be moved upward quickly. The piston rod 23 is moved upward with the piston 21, thereby generating a vacuum suction on the pressurizing cylinder chamber 16 whereby the ball 15 is drawn to block the liquid outlet port 14 while the ball 13 is drawn to open the liquid inlet port 12 so that the hydraulic oil can be filled into the pressurizing cylinder chamber 16. The piston 21 is then moved to press the block ring 395 to block the slots 3911 while the direction change piston 393 is moved upward. As shown in FIG. 3, the O-ring 392 on the spline 391 is moved upward to detach from the inner wall of the lower valve plug 38, thereby opening the air hole A5 so that the air can be introduced through the air inlet port 40 into the gas cylinder 20 to move the piston 21 downward, thereby simultaneously moving the piston rod 23 to compress the air contained in the pressurizing cylinder chamber 16. The above-mentioned steps can be repeated again and again.

Figure 10:
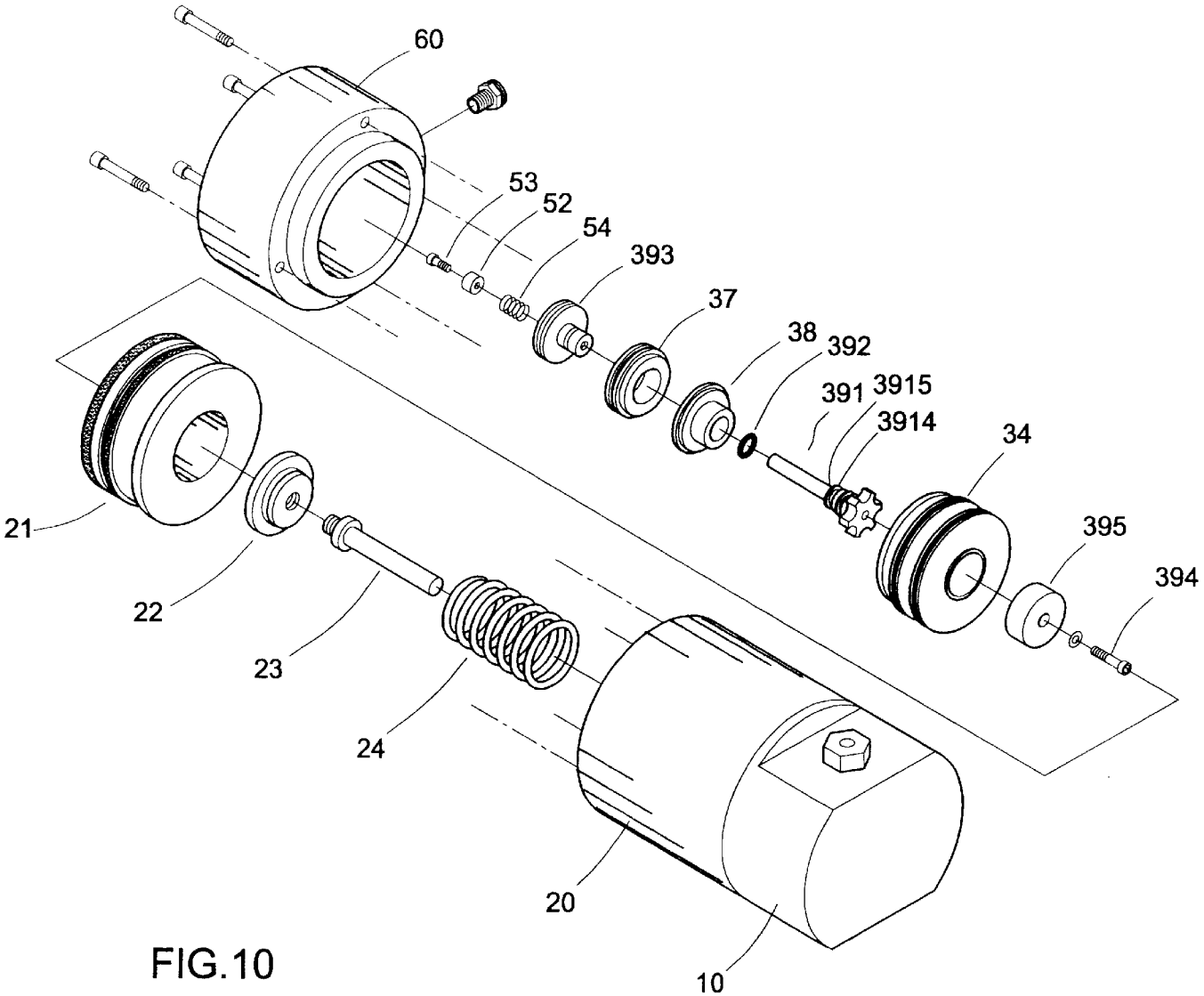
FIG. 10 is an exploded view of a double-force type pressure cylinder structure in accordance with another embodiment of the present invention.
Figure 11:
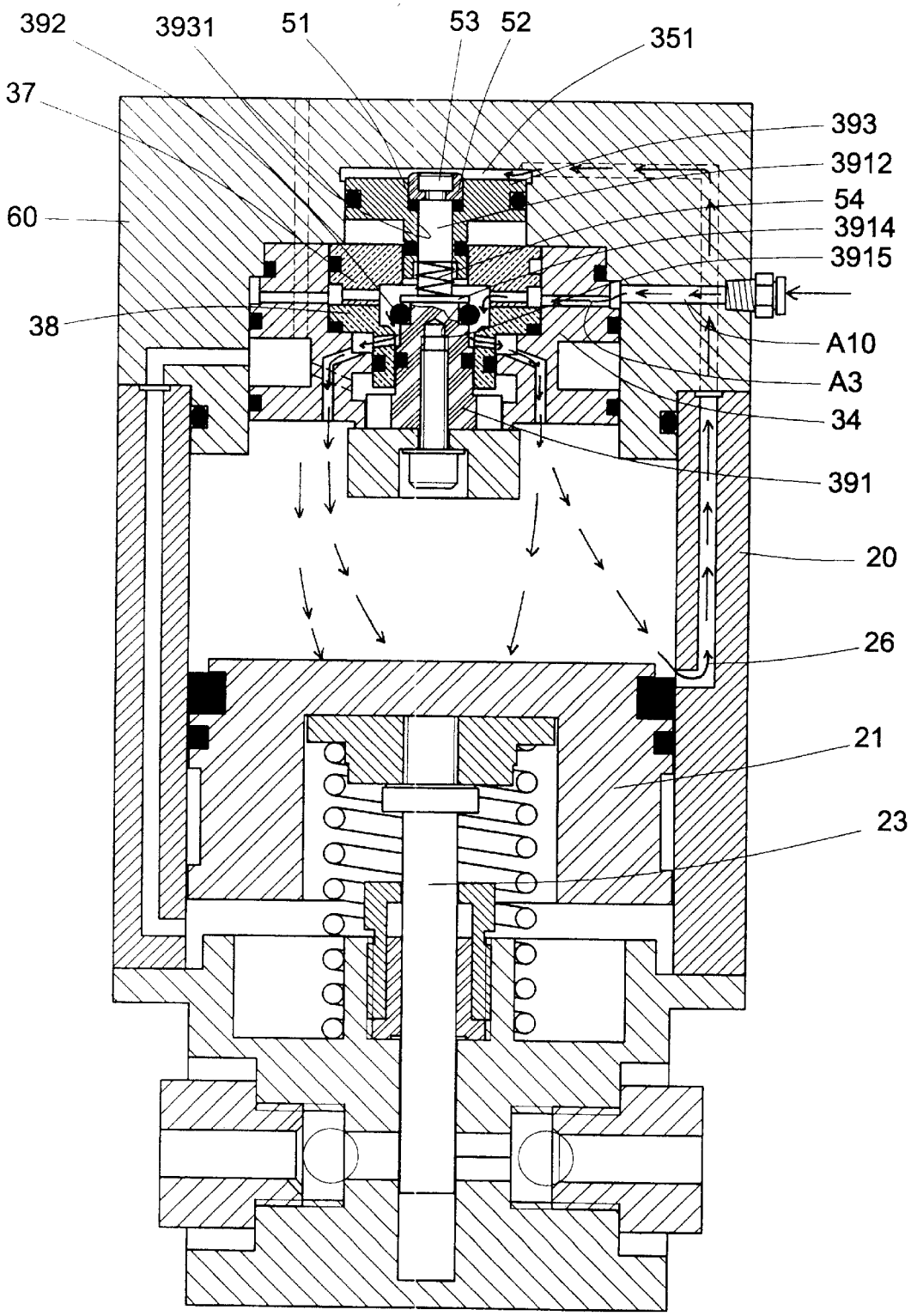
FIG. 11 is a cross-sectional assembly view of the double-force type pressure cylinder structure as shown in FIG. 10.

Referring to FIGS. 10 and 11, according to another embodiment of the present invention, the top cap 30 and the upper piston base 35 are integrally coupled with each other to form a top cover 60 which defines an air hole A10 connected to the first radial hole A3 of the lower piston base 34 so that the air can be introduced into the gas cylinder 20 fluently.

The direction change piston 393 defines a through stepped hole 3931 for receiving an extension rod 3912 of the spline 391 therein. A buffer spring 54 is mounted on the extension rod 3912 of the spline 391 and positioned in the bottom of the stepped hole 3931 of the direction change piston 393. An O-ring 51 is mounted on the extension rod 3912. A washer 52 is mounted in the top of the stepped hole 3931 of the direction change piston 393. A screw 53 extends through the washer 52 and is screwed into the top end of the extension rod 3912 of the spline 391 so that a buffer space is defined between the direction change piston 393 and the spline 391 whereby the spline 391 is not moved with the piston 21 simultaneously. The extension rod 3912 of the spline 391 has a bottom provided with a catch flange 3914 abutting the buffer spring 54. The catch flange 3914 has a bottom defining an annular groove 3915 for securing an O-ring 392 therein.

Referring to FIG. 11, when the piston 21 is moved to a position lower the level of the direction change air drain hole 26, the compressed air is introduced into the inner cylinder chamber 351 of the upper piston base 35 to push the direction change piston 393 downward.

Figure 12:
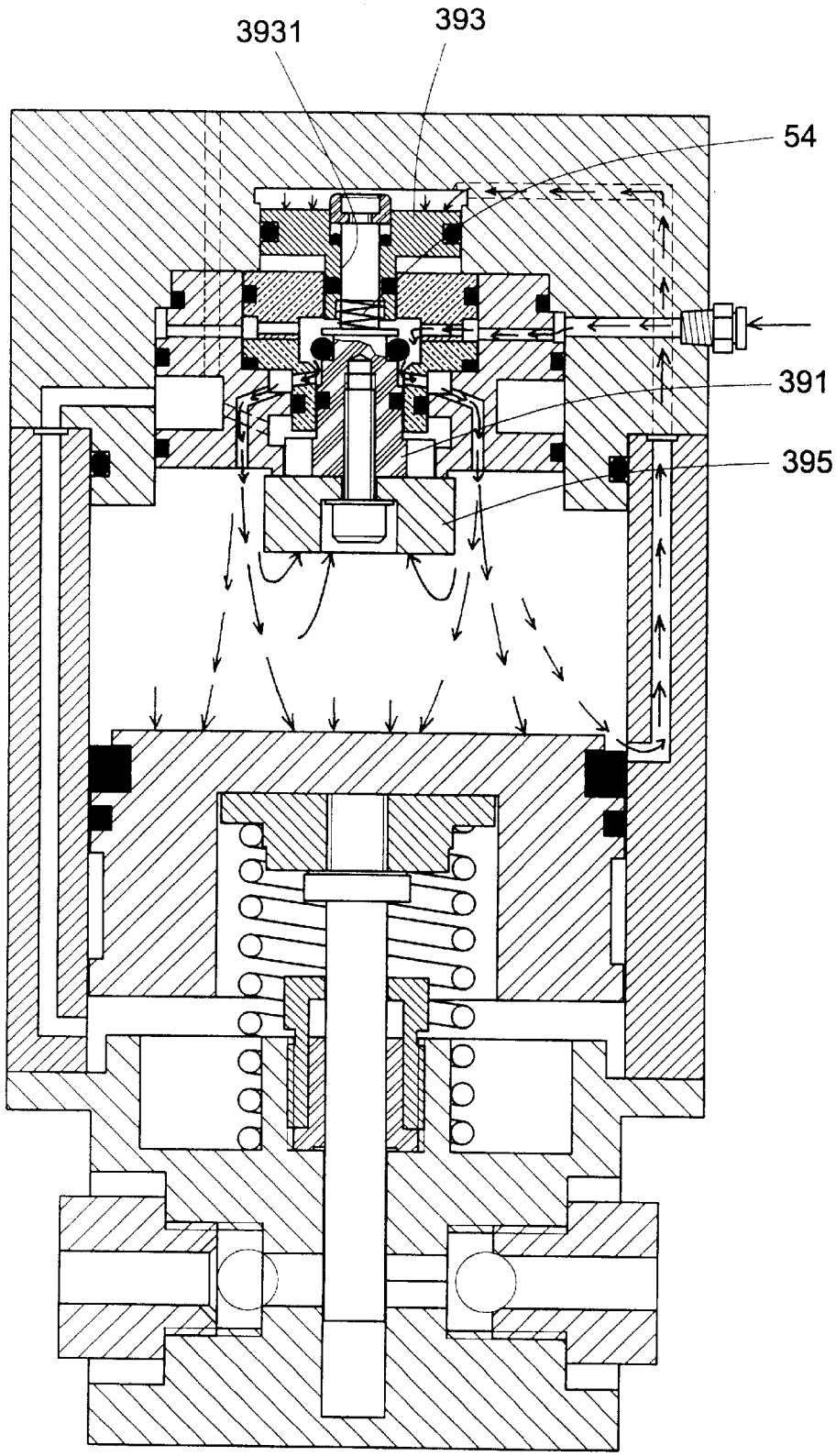
FIG. 12 is an operational view of the double-force type pressure cylinder structure as shown in FIG. 11.

As shown in FIG. 12, when the direction change piston 393 is moved downward, the buffer spring 54 is compressed while the block ring 395 is pushed by the compressed air to maintain the spline 391 at a stationary state.

Figure 13:
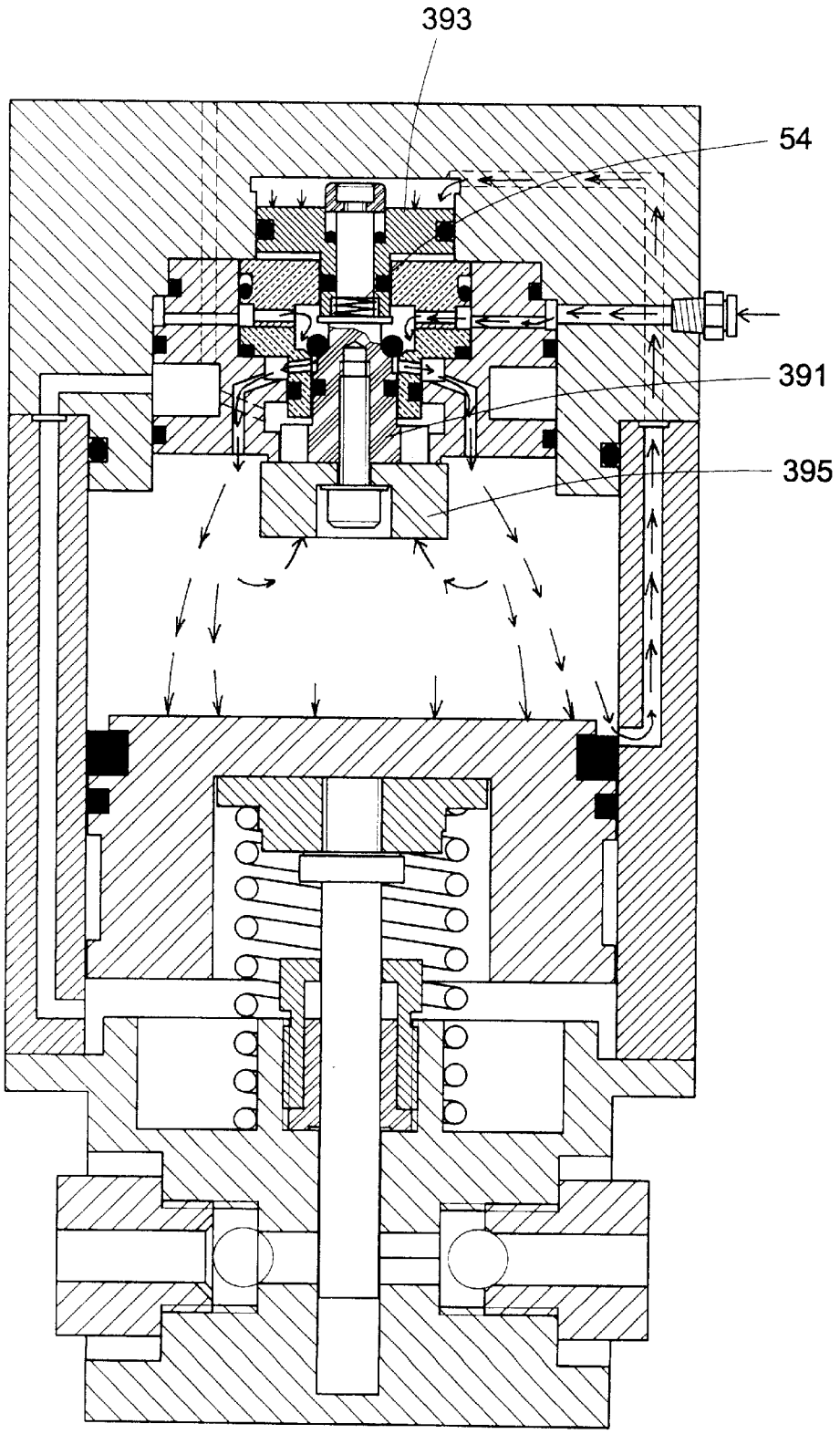
FIG. 13 is an operational view of the double-force type pressure cylinder structure as shown in FIG. 12.

As shown in FIG. 13, when the buffer spring 54 is compressed to its limit, the force on the direction change piston 393 plus the elastic force of the buffer spring 54 is greater than the thrust on the block ring 395.

Figure 14:
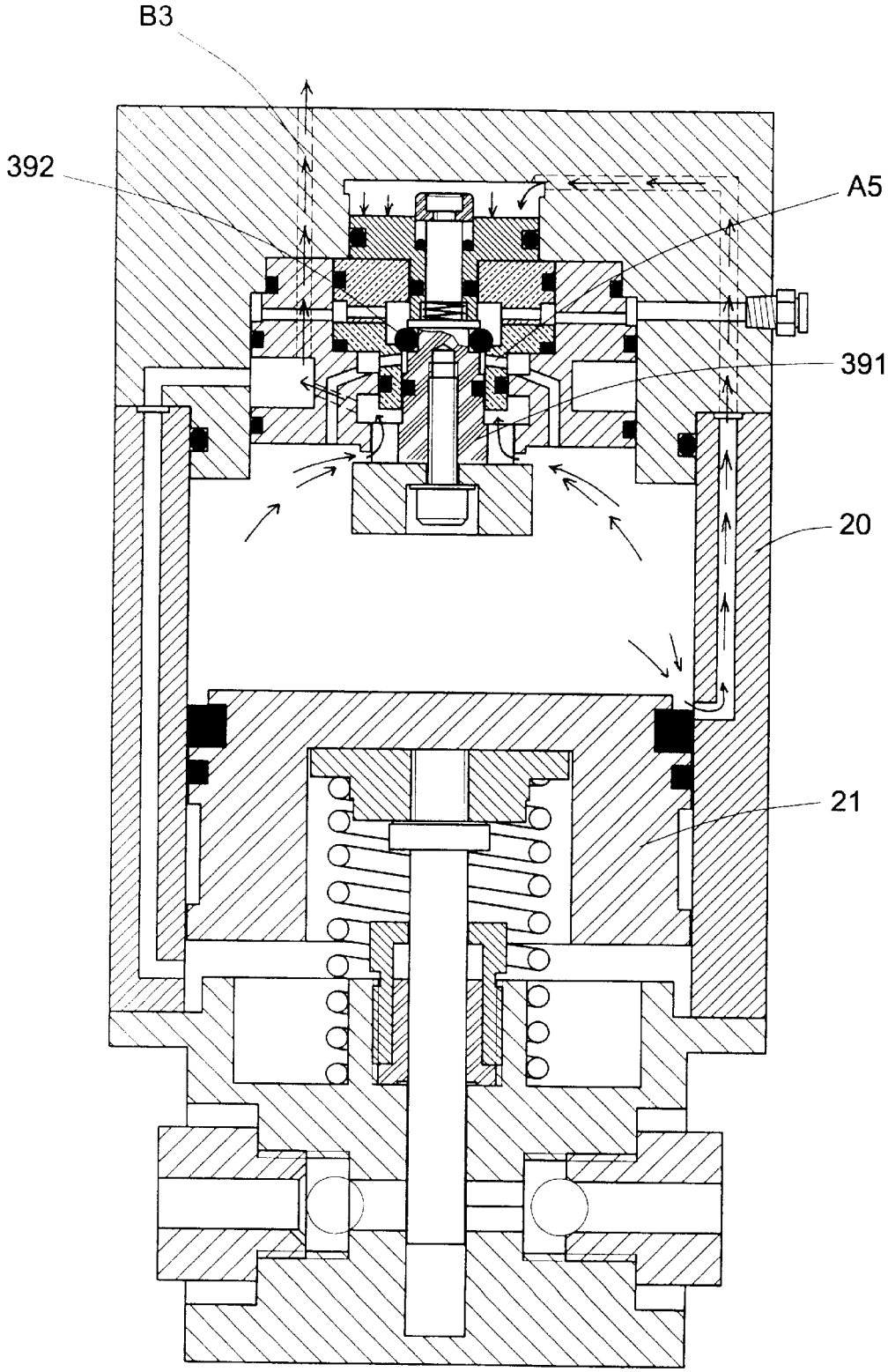
FIG. 14 is an operational view of the double-force type pressure cylinder structure as shown in FIG. 13.

As shown in FIG. 14, the O-ring 392 on the spline 391 is moved to press the inner wall of the lower valve plug 38, thereby blocking the air hole A5 so that the air cannot be introduced into the gas cylinder 20 whereby the air in the gas cylinder 20 is drained through the air drain hole B3 so that the piston 21 can be moved upward.

Accordingly, the piston is moved reciprocally so that the piston rod continuously compress that air into the oil cylinder of a double-force type vice, thereby successively supplying pressure so as to enhance the holding strength of the vice. In addition, the single air inlet port supplies the air into the gas cylinder while the spring exerts a restoring force so that the piston can be moved quickly, thereby enhancing the working efficiency of double-force type pressure cylinder structure.

It should be clear to those skilled in the art that further embodiments may be made without departing from the scope of the present invention.

What is claimed is:

1. A double-force type pressure cylinder-structure comprising:

a pressurizing cylinder base (10) defining a radial through hole (11) having a first side threadedly provided with a liquid inlet port (12) having a distal end for receiving a first ball (13), thereby forming a first check valve, and having a second side threadedly provided with a liquid outlet port (14) having a distal end for receiving a second ball (15), thereby forming a second check valve, said pressure cylinder base (10) having a central portion defining a pressurizing cylinder chamber (16) for receiving a piston rod (23), said pressurizing cylinder chamber (16) having a top defining a screw hole (17) for receiving a sealing bushing (18), a support bushing (19) screwed into said screw hole (17) for securing said sealing bushing (18) and for supporting said piston rod (23) which is sealed by said sealing bushing (18);

a gas cylinder (20) secured on said pressurizing cylinder base (10) and containing a piston (21) therein, said piston (21) having a bottom defining an inner annular hole (211) for receiving a flange disk (22), said flange disk (22) having a central portion screwed on one end of said piston rod (23), a spring (24) having a first end secured on said flange disk (22) and a second end secured on an end face of said pressurizing cylinder base (10) so that said piston (21) is pushed upward by said spring (24), a main air drain hole (25) longitudinally defined in a wall of said gas cylinder (20) and extending into a bottom of said gas cylinder (20), a direction change air drain hole (26) longitudinally defined in said wall of said gas cylinder (20) and extending into a mediate portion of said gas cylinder (20); and a top cap (30) secured on said gas cylinder (20) by bolts (31) and having a central portion defining a through stepped hole (32), said stepped hole (32) provided with an inner flange (33), said inner flange (33) having a bottom for receiving a lower piston base (34) and a top for receiving an upper piston base (35) which is screwed by bolts (36), said upper piston base (35) defining an inner cylinder chamber (351), said lower piston base (34) having an upper portion defining a concave annular hole (343) for receiving an upper valve plug (37) and a lower valve plug (38), and having a lower portion for receiving a spline (391) which defines a plurality of radially arranged slots (3911), an O-ring (392) mounted on a distal end of said spline (391), a direction change piston (393) slidably mounted in said inner cylinder chamber (351) of said upper piston base (35) and having an axle extending into said upper valve plug (37) and abutting an end face of said spline (391), a threaded post (394) extending through a block ring (395), through said spline (391) and screwed into said axle of said direction change piston (393) so that said spline (391) is integrally coupled with said direction change piston (393) while said block ring (395) closes said slots (3911) of said spline (391).

2. The double-force type pressure cylinder structure in accordance with claim 1, wherein said upper piston base (35) defines a first air hole (A1) extending therethrough and has a top threadedly secured with an air inlet port (40) connected to said first air hole (A1) of said upper piston base (35), said inner flange (33) defining a second air hole (A2), said second air hole (A2) having a first side connected to said first air hole (A1) and a second side connected to a first radial hole (A3) defined in said lower piston base (34), said first radial hole (A3) having a distal end connected to a second radial hole (A4) defined in said upper valve plug (37), said second radial hole (A4) connected between said upper valve plug (37) and said lower valve plug (38), an air vent hole (A5) defined in said lower valve plug (38) and connected to an air guide hole (A6) defined in said lower piston base (34), and said air guide hole (A6) connected to a inside of said gas cylinder (20).

3. The double-force type pressure cylinder structure in accordance with claim 1, wherein said top cap (30) defines a first air hole (B1) connected to said main air drain hole (25) of said gas cylinder (20) and connected to an annular groove (341) defined in said lower piston base (34), a second air hole (B2) defined in said lower piston base (34) and connected to said annular groove (341), an air drain hole (B3) defined in said upper piston base (35) and connected to said second air hole (B2).

4. The double-force type pressure cylinder structure in accordance with claim 1, wherein said top cap (30) defines a first air hole (C1) connected to said direction change air drain hole (25) of said gas cylinder (20) and connected to an annular groove (352) defined in said upper piston base (35), a second air hole (C2) defined in said upper piston base (35) and connected between said annular groove (352) of said upper piston base (35) and said inner cylinder chamber (351) of said upper piston base (35).

5. The double-force type pressure cylinder structure in accordance with claim 3, wherein said lower piston base (34) defines an air supply hole (B4) connected to said annular groove (341) and connected to said slots (3911) of said spline (39).

6. The double-force type pressure cylinder structure in accordance with claim 3, wherein said upper piston base (35) defines an air hole (D) connected to said air drain hole (B3) of said upper piston base (35) and connected to said inner cylinder chamber (351).

7. The double-force type pressure cylinder structure in accordance with claim 1, wherein said direction change piston (393) defines a through stepped hole (3931) for receiving an extension rod (3912) of said spline (391) therein, a buffer spring (54) mounted on said extension rod (3912) of said spline (391) and positioned in a bottom of said stepped hole (3931) of said direction change piston (393), an O-ring (51) mounted on said extension rod (3912), a washer (52) mounted in a top of said stepped hole (3931) of said direction change piston (393), and a screw (53) extending through said washer (52) and screwed into a top end of said extension rod (3912) of said spline (391) so that a buffer space is defined between said direction change piston (393) and said spline (391).

8. The double-force type pressure cylinder structure in accordance with claim 7, wherein said extension rod (3912) of said spline (391) has a bottom provided with a catch flange (3914) abutting said buffer spring (54), said catch flange (3914) having a bottom defining an annular groove (3915) for securing an O-ring (392) therein.

9. The double-force type pressure cylinder structure in accordance with claim 2, wherein said top cap (30) and said upper piston base (35) are integrally coupled with each other to form a top cover (60) which defines an air hole (A10) connected to said first radial hole (A3) of said lower piston base (34).

* * * * *